US005761588A

United States Patent [19]

Mikawa et al.

[11] Patent Number: 5,761,588

[45] Date of Patent: Jun. 2, 1998

[54] IMAGE FORMING APPARATUS WITH MEMBER FOR REGULATING AN AMOUNT OF DEVELOPER ON A DEVELOPER TRANSPORTING MEMBER

[75] Inventors: Susumu Mikawa, Itami; Noboru Ito, Kawanishi, both of Japan

[73] Assignee: Minolta Co., Ltd., Osaka, Japan

[21] Appl. No.: 594,791

[22] Filed: Jan. 31, 1996

[30] Foreign Application Priority Data

Feb. 2, 1995 [JP] Japan ..... 7-039194

[51] Int. Cl.[6] ..... G03G 15/09

[52] U.S. Cl. ..... 399/274

[58] Field of Search ..... 399/260, 274, 399/284, 45, 58

[56] References Cited

U.S. PATENT DOCUMENTS

| | | | |
|---|---|---|---|
| 4,974,024 | 11/1990 | Bares et al. | 399/58 |
| 5,202,769 | 4/1993 | Suzuki | 399/58 X |
| 5,289,237 | 2/1994 | Hashizume et al. | 399/284 |
| 5,517,286 | 5/1996 | Tada et al. | 399/274 |

FOREIGN PATENT DOCUMENTS

| | | |
|---|---|---|
| 60-93470 | 5/1985 | Japan . |
| 63-6749 | 2/1988 | Japan . |
| 2-137856 | 5/1990 | Japan . |

*Primary Examiner*—S. Lee

*Attorney, Agent, or Firm*—Burns, Doane, Swecker & Mathis, LLP

[57] ABSTRACT

A developing device which develops an electrostatic latent image formed on an image-bearing member in an image forming apparatus. The developing device has a developer transporting member for transporting a developer to the image-bearing member, and a rotatable regulating member provided at an upstream side from the developing region with respect to a transporting direction of the developer transporting member for regulating an amount of the developer held on the developer transporting member. The regulating member includes a regulating portion which has a section wherein a distance from a rotational axis of the regulating member to periphery of the regulating portion is not fixed.

30 Claims, 13 Drawing Sheets

IMAGE FORMING APPARATUS WITH MEMBER FOR REGULATING AN AMOUNT OF DEVELOPER ON A DEVELOPER TRANSPORTING MEMBER

BACKGROUND OF THE INVENTION

1. Field of the Invention

The present invention relates to an image forming apparatus such as a copying machine, printer and the like, and specifically relates to a developing device in an image forming apparatus that develops an electrostatic latent image formed on an image-bearing member by transporting a developer to the surface of said image-bearing member.

2. Description of the Related Art

In conventional developing devices provided in image forming apparatuses such as copiers, printers and the like, an electrostatic latent image formed on the surface of an image-bearing member is developed by maintaining and transporting toner on a developer-carrying member to said image-bearing member. A regulating member is provided opposite the developer-carrying member at a predetermined gap and on the upstream side of the developing region wherein the image-bearing member confronts the developer-carrying member with respect to a developer transport direction of the developer-carrying member. A constant amount of developer is normally maintained on the developer-carrying member by the regulating member, and transported to the image-bearing member.

When, however, the amount of developer transported from the developer-carrying member onto the image-bearing member is a constant amount via the aforesaid regulating member, the electrostatic latent image formed on the surface of the image-bearing member cannot be suitably developed. For example, when developing halftone images, or developing images containing fine lines or text images, it is not possible to change the amount of developer transported to the image-bearing member so as to suitably develop the respective images.

SUMMARY OF THE INVENTION

A main object of the present invention is to provide a developing device capable of normally providing excellent images.

Another object of the present invention is to provide a developing device capable of suitably developing in accordance with a status of an image to be developed.

The aforesaid objects are attained by providing a developing device described below.

A developing device comprising:

a developer transporting member opposite to an image-bearing member to form a developing region therebetween, said developer transporting member transporting a developer held thereon to the image-bearing member; and a rotatable regulating member provided at an upstream side from said developing region with respect to a developer transporting direction and regulating an amount of the developer held on the developer transporting member, said regulating member including a regulating portion which has a section wherein a distance from a rotational axis of the regulating member to periphery of the regulating portion is not fixed.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

FIG. 2(*b*) shows the state of the regulating member when developing a halftone image in the developing device of a first embodiment of the present invention;

FIG. 4(*b*) shows the state of the regulating member as shown in FIG. 4(*a*);

FIG. 5(*b*) shows the state of the regulating member when developing a halftone image in the developing the developing device of a second embodiment according to the present invention;

FIG. 6(*b*) shows the state wherein the regulating member is maintained at the position shown in FIG. 5(*b*) via a supportive rotating member and a solenoid in the developing device of the second embodiment according to the present invention;

FIG. 11(*b*) is an illustration showing the amount of developer transported to the image-bearing member by the developer-carrying member when the regulating member is at the position shown in FIG. 5(*b*) in a developing device of the second embodiment according to the present invention;

DETAILED DESCRIPTION OF THE PREFERRED EMBODIMENTS

Figure 1:
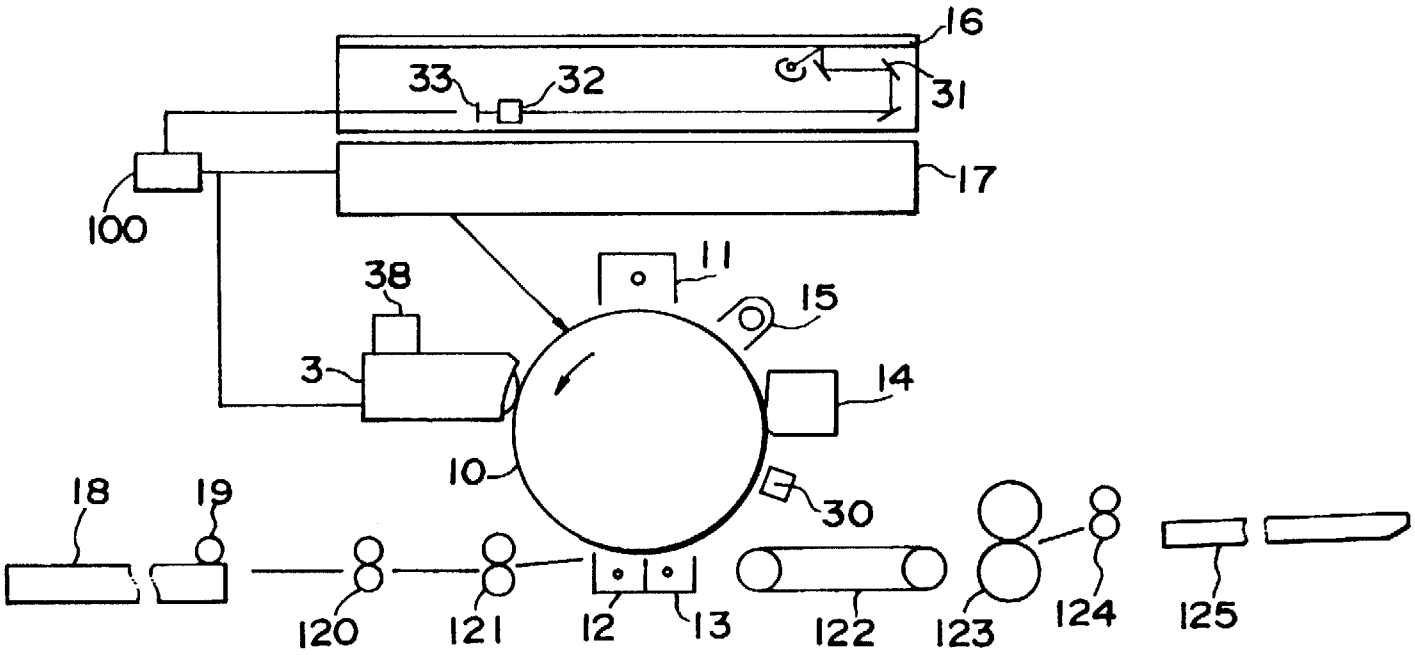
FIG. 1 is a brief section view of a digital copying machine provided with a developing device of first or second embodiment according to the present invention.

FIG. 1 briefly shows the construction of a digital copying machine provided with a developing device of first or second embodiment according to the present invention.

This copying machine is provided with an image-bearing member 10 around the periphery of which are sequentially provided a charger 11, developing device 3, transfer charger 12, separation charger 13, image density sensor 30, cleaning unit 14, and eraser 15.

A glass 16 for seating the document is provided above image-bearing member 10, and an optical unit 17 such as a laser or the like is provided below said glass 16. On the left side of image-bearing member 10 in the drawing are sequentially provided a pick-up roller 19 for picking up transfer sheets from paper cassette 18, an intermediate transport roller 120, and a timing roller 121. On the right side of image-bearing member 10 in the drawing are sequentially provided a transport belt 122, a discharge roller 124, and a discharge tray 125.

In this image forming apparatus, the surface of image-bearing member 10 is rotatably driven a counterclockwise direction in the drawing and is uniformly charged by charger 11.

On the other hand, an image of an original document placed on glass 16 is read by a reading section comprising a plurality of mirrors 31, lens 32, and charge-coupled device (CCD) 33, and the read image data are transmitted to central processing unit (CPU) 100. A laser beam from optical unit 17 irradiates the surface of image-bearing member 10 in accordance with image data transmitted from CPU 100, so as to form an electrostatic latent image on image-bearing member 10. This latent image is developed as a toner image by developing device 3, and the developed toner image is transported on said image-bearing member 10 to transfer charger 12.

A transfer sheet is fed from paper cassette 18 and transported via timing roller 21 onto transfer charger 12 synchronously with the toner image on image-bearing member 10.

The toner image on image-bearing member 10 is transferred onto the transfer sheet via the action of transfer charger 12, and after the transfer said transfer sheet is separated from transfer charger 12 by separation charger 13, and transported to fixing device 123 via transport belt 122. The toner image on the transfer sheet is fused thereon by fixing device 123 and subsequently discharged to discharge tray 125 by discharge roller 124.

The construction of a first embodiment of the developing device 3 according to the present invention is described below.

Figure 2A:
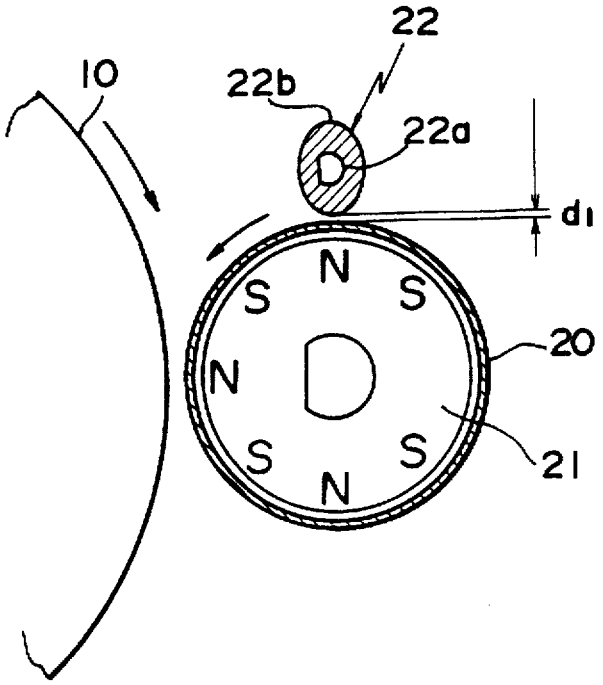
FIG. 2(*a*) shows the state of a regulating member when developing a line image in the developing device of the first embodiment according to the present invention.
Figure 2B:
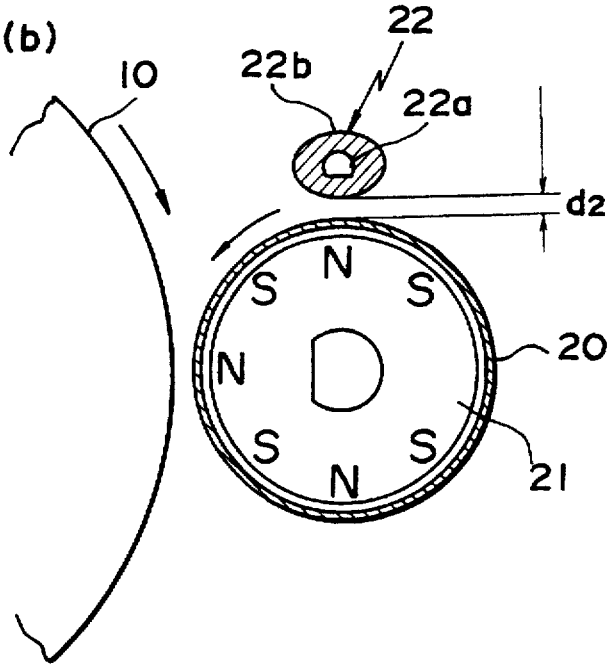

In the developing device of the first embodiment, a cylindrical developing sleeve 20 is provided as a developer transporting member for transporting developer to image-bearing member 10, as shown in FIGS. 2(*a*) and 2(*b*). On the interior side of developing sleeve 20 is disposed a magnet roller 21 provided with a plurality of magnetic poles N and S. An overlaid DC voltage and AC voltage is applied between the developing sleeve 20 and the image-bearing member 10 to accomplish development. Developer is magnetically maintained on the developing sleeve 20 via magnetic roller 21, and said developer is transported to the rotating image-bearing member 10 by means of the rotation of developing sleeve 20.

In the first embodiment, a rotatable member having an ellipse cross section and provided with a center rotating shaft 22*a* is used as regulating member 22 for regulating the amount of developer transported to image-bearing member 10 by the aforesaid developing sleeve 20. Regulating member 22 is disposed at a position adjacent to developing sleeve 20 so as to be rotatable upon the aforesaid rotating shaft 22*a*. The gap between the ellipse surface 22*b* of regulating member 22 and the developing sleeve 20 changes by means of the rotating of regulating member 22.

Described hereinafter is the operation for changing the amount of developer transported to image-bearing member 10 in accordance with an electrostatic latent image formed on the surface of image-bearing member 10 using the aforesaid regulating member 22 in the developing device of the first embodiment according to the present invention.

Figure 3:
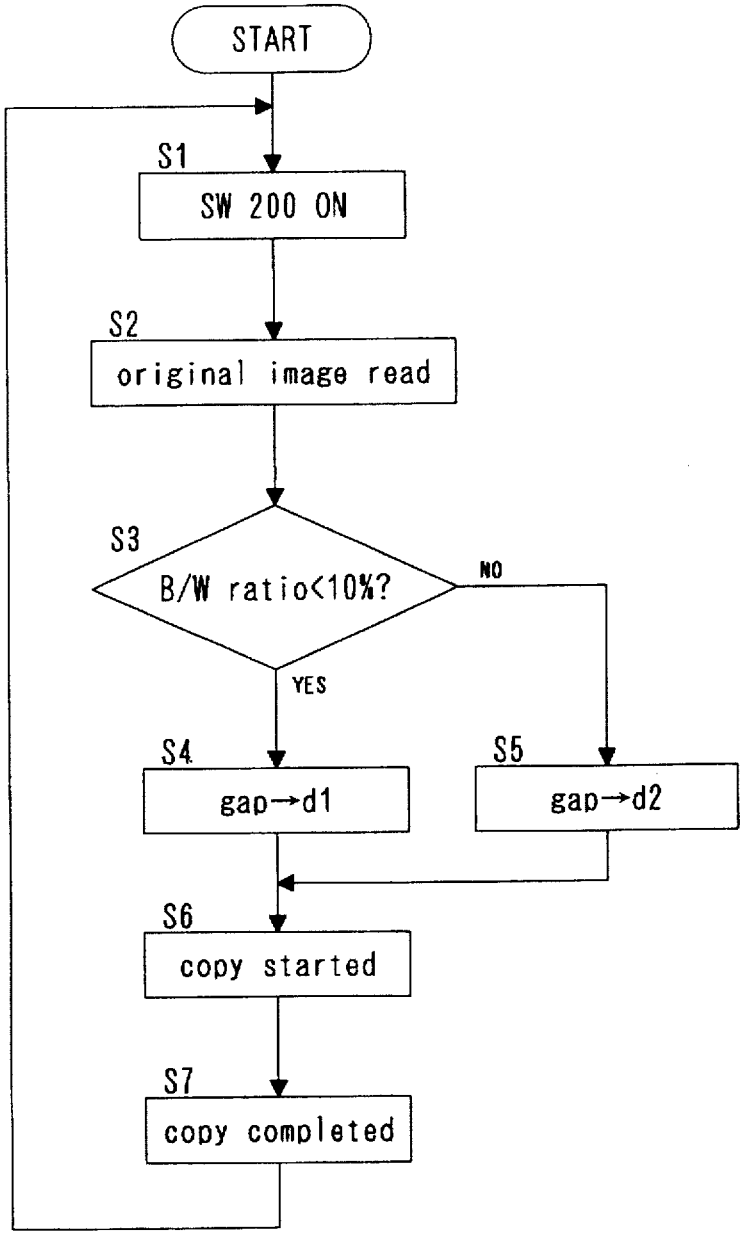
FIG. 3 is a flow chart of the copying operation of the digital copying machine provided with a developing device of the first embodiment according to the present invention.

FIG. 3 is a flow chart of the copying operation of the digital copying machine shown in FIG. 1. When an original document is placed on glass 16 and a copy switch 200 is turned ON (step S1), said original document is read by optical unit 17 (step S2). The image data of the read document are transmitted to CPU 100, and a check is made to determined whether or not the black/white ratio of the document image is 10% or greater (step S3).

When it is determined in step S3 that the black/white ratio of the document is less than 10%, the document image is determined to be either text or an image having many fine lines, and in step S4 the gap between the exterior surface 22*b* of regulating member 22 and the developing sleeve 20 is set at a gap of d1. (Refer now to FIG. 2(*a*).) Thus, the amount of developer transported to image-bearing member 10 is reduced.

On the other hand, when the black/white ratio of the document image is determined to be 10% or greater in step S3, the document image is determined to be an image having many halftones such as a photographic image, and in step S5 the gap between the exterior surface 22*b* of regulating member 22 and the developing sleeve 20 is set at a gap of d2. (Refer now to FIG. 2(*b*).) Thus, the amount of developer transported to image-bearing member 10 is increased. After either gap d1 or gap d2 between the regulating member 22 and the developing sleeve 20 has been set, the operation continues to step S6 whereupon the image forming operation starts, and in step S7 the image forming operation is completed.

When regulating member 22 having the previously described ellipse cross section is rotated so as to change the gap between the exterior surface 22*b* of regulating member 22 and the developing sleeve 20, the gap is enlarged between developing sleeve 20 and the exterior surface 22*b* of regulating member 22, as shown in FIG. 2(*b*), such that there is an increase in the amount of developer transported to image-bearing member 10 by developing sleeve 20. Thereafter, there is no great stress exerted on the developer on the developing sleeve 20 even when regulating member 22 is rotated so as to narrow the gap between developing sleeve 20 and the exterior surface 22*b* of regulating member 22, as shown in FIG. 2(*a*), such that said developer does not flocculate nor become fatigued.

In the developing device of the first embodiment, a member having an ellipse cross section is used as the regulating member 22 so as to change the gap between the developing sleeve 20 and the regulating member 22 having an ellipse cross section by rotating said regulating member 22, thereby allowing suitable adjustment of the gap between developing sleeve 20 and regulating member 22 having an ellipse cross section by simply rotating said regulating member 22, and consequently allowing adjustment of the amount of developer transported to the image-bearing member 10 by said developing sleeve 20 in a stepless operation.

The configuration of the regulating member used in the developing device of the first embodiment is not, however, specifically limited to the configuration specified in the present embodiment. For example, a regulating member 23 may be used as shown in FIGS. 4(*a*) and 4(*b*), wherein said regulating member 23 comprises a first regulating portion 23*b* provided at a position separated from a rotating shaft 23*a*, and a second regulating portion 23*c* provided at a position nearer said rotating shaft 23*a* than said first regulating member 23*b*.

Figure 4A:
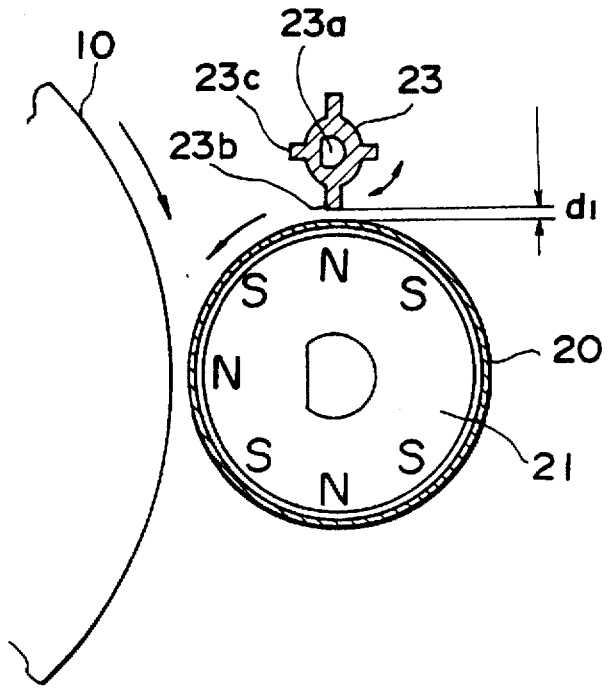
FIG. 4(*a*) shows the state of the regulating member as a modified example of the regulating member in the developing device of the first embodiment when developing a line image.
Figure 4B:
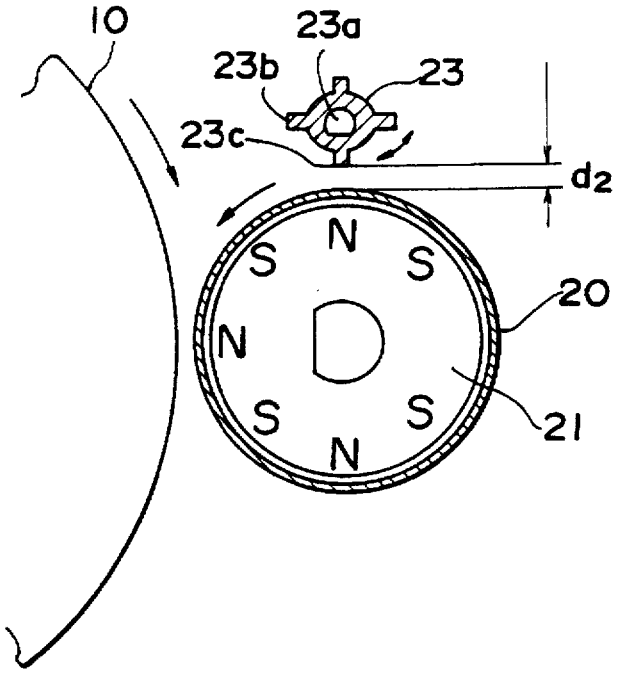

In the digital copying machine having a developing device which uses a regulating member 23 provided with the aforesaid first regulating portion 23*b* and the aforesaid second regulating portion 23*c*, when the original document image is determined to be a line image, the regulating member 23 is rotated so as to narrow the gap between the developing sleeve 20 by positioning the first regulating portion 23*b* opposite the developing sleeve 20, as shown in FIG. 4(*a*). On the other hand, when an original document image is determined to be a halftone image, the regulating member 23 is rotated so as to widen the gap between the developing sleeve 20 by positioning the second regulating portion 23*c* opposite the developing sleeve 20, as shown in FIG. 4(*b*).

In a similar manner to that described in the first embodiment, when regulating member 23 is rotated so the second regulating portion 23*c* of regulating member 23 opposes the developing sleeve 20, the gap is widened between developing sleeve 20 and the regulating member 23, as shown in FIG. 4(*b*), such that there is an increase in the amount of developer transported to image-bearing member 10 by developing sleeve 20. Thereafter, there is no great stress exerted on the developer on the developing sleeve 20 even when regulating member 23 is rotated so that the first regulating portion 23*b* of regulating member 23 opposes the developing sleeve 20, as shown in FIG. 4(*a*), such that said developer does not flocculate nor become fatigued.

Although two types of regulating portions, i.e., first regulating portion 23*b* and second regulating portion 23*c*, have been provided in the aforesaid regulating member 23, it is possible to provide a third regulating portion and a fourth regulating portion at different distance from the rotating shaft 23*a*.

The construction of developing device 3 of a second embodiment according to the present invention is described hereinafter.

Figure 5:
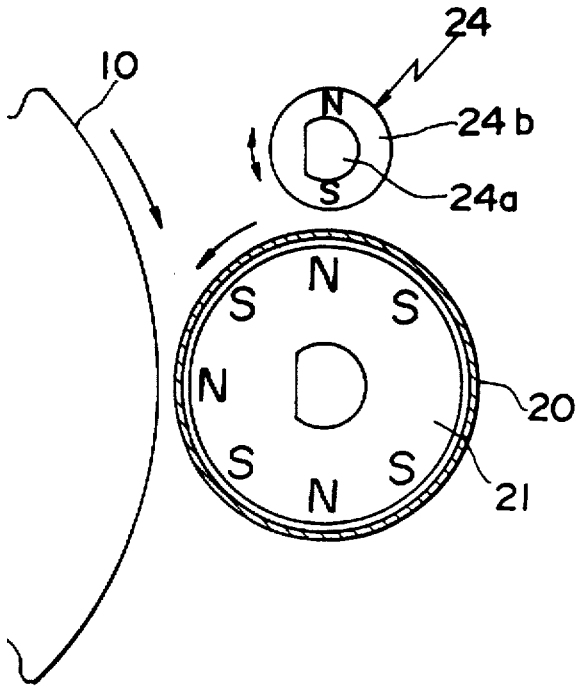
FIG. 5(*a*) shows the state of the regulating member when developing a line image in the developing device of the second embodiment according to the present invention.
Figure 5:
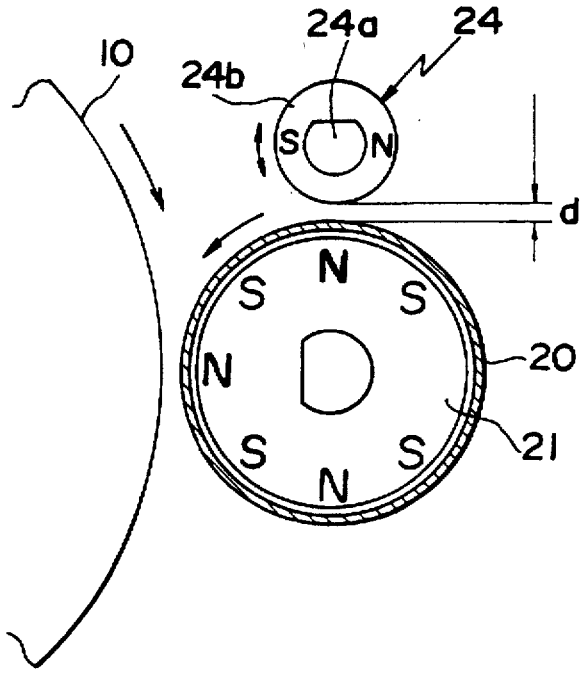

Similar to the developing device of the first embodiment, a cylindrical developing sleeve 20 is used as a developer transporting member for transporting developer to image-bearing member 10 in the developing device of the second embodiment as shown in FIGS. 5(*a*) and 5(*b*), said developing sleeve 20 being provided on its interior side with a magnet roller 21 having a plurality of magnetic poles N and S, such that developer is magnetically maintained on the surface of developing sleeve 20 via magnet roller 21 so as to be transported to image-bearing member 10 via the rotation of said developing sleeve 20.

In the developing device of the second embodiment, the amount of developer transported to image-bearing member 10 by developing sleeve 20 is regulated by the regulating member 24 which is provided with a center rotating shaft 24*a* of magnet roller 24*b* having an N magnetic pole and an S magnetic pole. Regulating member 24 is arranged at a position adjacent to the aforesaid developing sleeve 20. When regulating member 24 is rotated upon center rotating shaft 24*a*, the S magnetic pole of magnet roller 24*b* of regulating member 24 approaches developing sleeve 20 at a position opposite the N magnetic pole of magnet roller 21 provided within developing sleeve 20, so as to cause separation from developing sleeve 20.

Figure 6A:
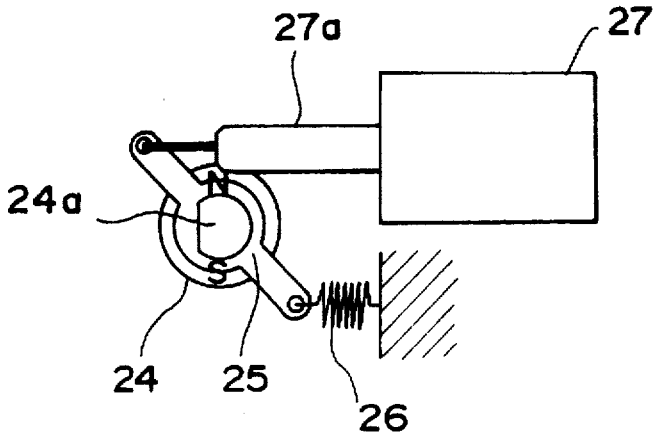
FIG. 6(*a*) shows the state wherein the regulating member is maintained at the position shown in FIG. 5(*a*) via a supportive rotating member and a solenoid in the developing device of the second embodiment according to the present invention.
Figure 6B:
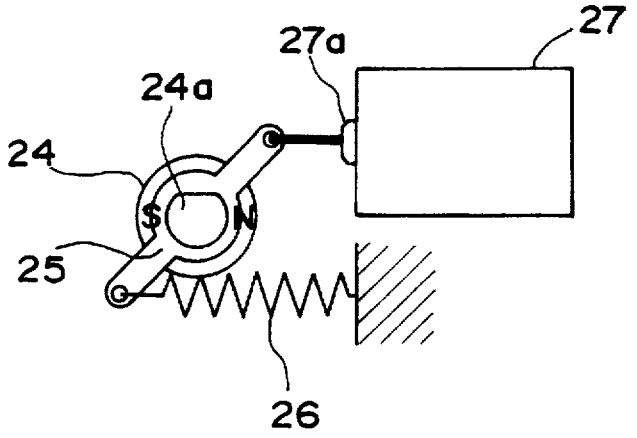

In the second embodiment, as shown in FIGS. 6(*a*) and 6(*b*), the rotation of regulating member 24 is accomplished by attaching a supportive rotating member 25 on rotating shaft 24*a* of regulating member 24, attaching a spring 26 on one end of supporting rotating member 25 extending in a perpendicular direction thereto, and attaching on the other end of said supportive rotating member 25 a rod 27*a* which is reciprocally driven by a solenoid 27.

As shown in FIG. 6(*a*), with solenoid 27 in the OFF state, one end of the supportive rotating member 25 is pulled by the spring 26, such that the S magnetic pole of regulating member 24 approaches developing sleeve 20 at a position opposite the N magnetic pole of magnetic roller 21 provided within said developing sleeve 20. While, as shown in FIG. 6(*b*), when solenoid 27 is in the ON state, the reciprocating rod 27*a* is retracted against the force of spring 26, such that the other end of supportive rotating member 25 is pulled by said solenoid 27 causing the rotating shaft 24*a* to rotate, and the S magnetic pole of regulating member 24 is separated from developing sleeve 20 so as not to be opposite the N magnetic pole of magnet roller 21.

The operation of changing the amount of developer transported to image-bearing member 10 in accordance with an electrostatic latent image formed on the surface-of said image-bearing member 10 using the aforesaid regulating member 24 in the developing device of the second embodiment according to the present invention is described below.

Figure 7:
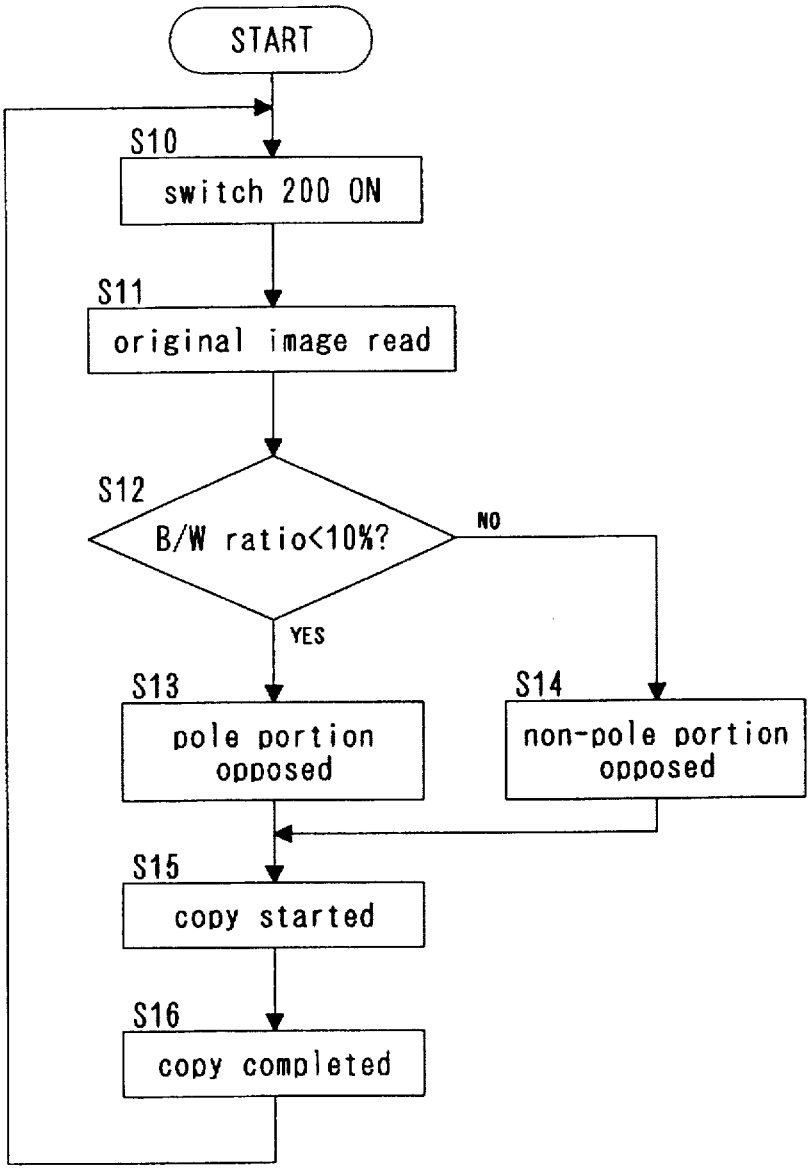
FIG. 7 is a flow chart of the copying operation of the digital copying machine provided with a developing device of the second embodiment according to the present invention.

FIG. 7 is a flow chart of the copying operation of the digital copying machine shown in FIG. 1. When a document is placed on glass 16 and copy start switch 200 is turned ON (step S10), the document is read by optical unit 17 (step S11). The image data of the read document is transmitted to CPU 100, and a check is made to determine whether or not the black/white ratio of the document image is 10% or greater (step S12).

Figure 11A:
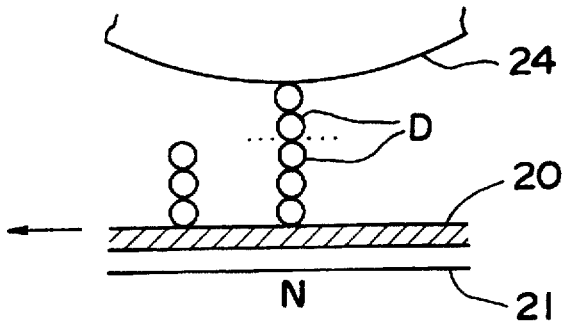
FIG. 11(*a*) is an illustration showing the amount of developer transported to the image-bearing member by the developer-carrying member when the regulating member is at the position shown in FIG. 5(*a*) in a developing device of the second embodiment according to the present invention.
Figure 11B:
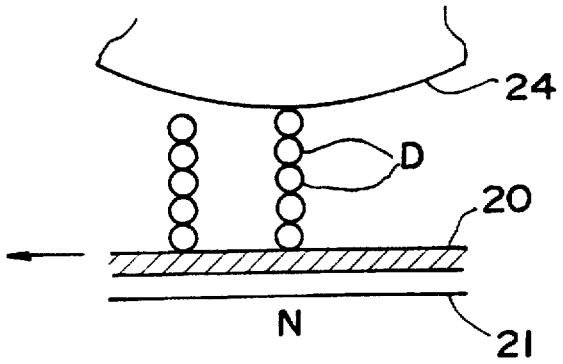

When it is determined in step S12 that the black/white ratio of the document image is less than 10%, the document image is determined to be text image or an image having many fine lines. Then, in step S13 solenoid 17 is not turned ON and remains in the OFF state, and the S magnetic pole of regulating member 24 approaches developing sleeve 20 at a position opposite the N magnetic pole of magnetic roller 21 provided within developing sleeve 20, as shown in FIGS. 5(*a*) and 6(*a*). Thus, as shown in FIG. 11(*a*), when the developer D on the surface of developing sleeve 20 is transported while being held by the magnetic force of magnet roller 21 and arrives at a position opposite regulating member 24, said developer D is attracted by the S magnetic pole of regulating member 24 and a portion of the developer D on developing sleeve 20 remains attracted by the S magnetic pole of regulating member 24, thereby reducing the amount of developer D transported to image-bearing member 10 by developing sleeve 20.

On the other hand, when the black/white ratio of the document image is determined to be 10% or greater in step S12, the document image is determined to be an image having many halftones such as a photographic image. Then, as shown in FIGS. 5(*b*) and 6(*b*), solenoid 27 is turned ON in step S14 to rotate regulating member 24 against the force of spring 26 and separate the S magnetic pole of regulating member 24 from developing sleeve 20, and the region medial to the N magnetic pole and the S magnetic pole of regulating member 24 is brought opposite developing sleeve 20. Thus, as shown in FIG. 11(*b*), the developer D on developing sleeve 20 is transported while being held by the magnetic force of magnetic roller 21 and arrives at a position opposite regulating member 24, and more developer D is transported to image-bearing member 10 via developing sleeve 20 in accordance with the gap between regulating member 24 and developing sleeve 20 inasmuch as developer D is not magnetically attracted to regulating member 24.

When regulating member 24 is rotated by turning ON and OFF solenoid 27 to change the position of the S magnetic pole of regulating-member 24 and thereby change the amount of developer transported to image-bearing member 10 by developing sleeve 20, there is no great stress exerted on the developer nor is there flocculation or fatigue of the developer even when regulating member 24 is rotated so as to position the S magnetic pole of regulating member 24 opposite the N magnetic pole of magnetic roller 21 as shown in FIG. 5(*a*) to produce a reduction in the amount of developer transported to image-bearing member 10 by developing sleeve 20 after the S magnetic pole of regulating member 24 has been separated from developing sleeve 20 as shown in FIG. 5(*b*) to increase the amount of developer transported to image-bearing member 10 by developing sleeve 20.

The amount of reciprocation of reciprocating rod 27*a* of solenoid 27 can be adjusted to freely change the position of the S magnetic pole of regulating member 24, so as to make suitable adjustment of the amount of developer remaining on regulating member 24 attracted by the S magnetic pole of regulating member 24 and thereby freely change the amount of developer transported to image-bearing member 10 by developing sleeve 20.

Figure 14:
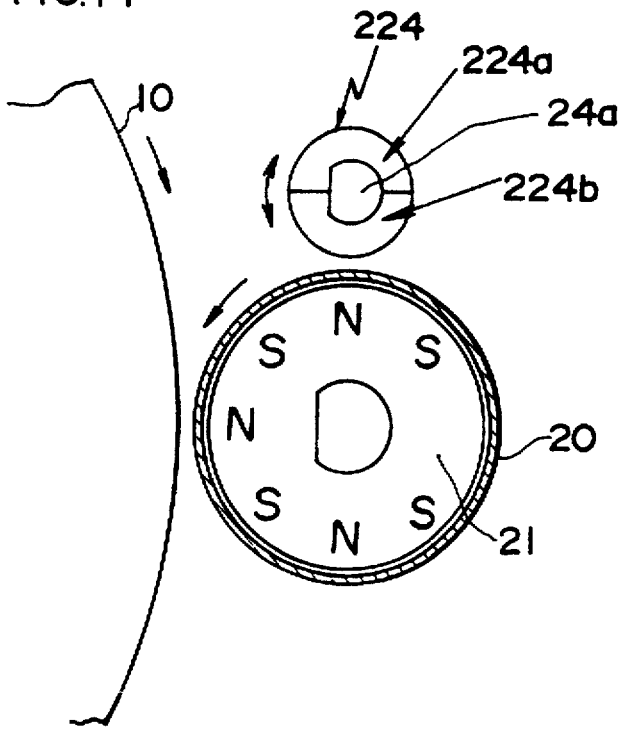
FIG. 14 shows the regulating member as a modified example of the regulating member in the developing device of the second embodiment according to the present invention.

The structure of the regulating member 24 used in the developing device of the second embodiment is not, however, specifically limited to the structure specified in the present embodiment. For example, a regulating member 224 may be used as shown in FIG. 14. The regulating member 224 includes a rotatable roller having a rotating shaft 24*a*, a magnetic portion 224*a* and non-magnetic portion 224*b* respectively provided around the rotating shaft 24*a*.

In the digital copying machine having a developing device which uses the regulating member 224, when the original document image is determined to be a line image, the regulating member 224 is rotated so that the magnetic portion 224*a* opposes the N magnetic pole of the magnetic roller 21 provided within developing sleeve 20. As a result, the developer is attracted by the magnetic portion 224*a* of the regulating member 224, and a portion of the developer on the developing sleeve 20 remains attracted by the magnetic portion 224*a* of the regulating member 224, thereby reducing the amount of the developer transported to image-bearing member 10 by developing sleeve 20. On the other hand, when the original document image is determined to be an image having many halftone images such as a photographic image, the regulating member 224 is rotated so that the non-magnetic portion 224*b* opposes the N magnetic pole of the magnetic roller 21 provided within developing sleeve 20. As a result, the developer on developing sleeve 20 is transported while being held by the magnetic force of the magnetic roller 21 and arrives at a position opposite regulating member 224, and more developer is transported to image-bearing member 10 via developing sleeve 20 in accordance with the gap between regulating member 224 and developing sleeve 20 inasmuch as developer is not magnetically attracted to regulating member 224.

Figure 15:
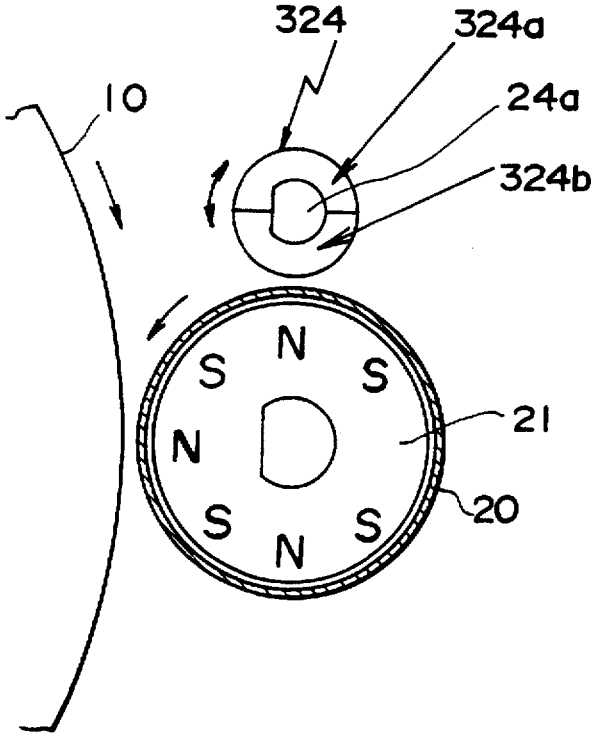
FIG. 15 shows the regulating member as another modified example of the regulating member in the developing device of the second embodiment according to the present invention.

Further, in the developing device of the second embodiment, a regulating member 324 as shown in FIG. 15 may be also used. The regulating member 324 includes a rotatable roller having a rotating shaft 24*a*, a first portion 324*a* and a second portion 324*b* respectively provided around the rotating shaft 24*a*. The first portion has a high permeability and the second portion 324*b* has a low permeability.

In the digital copying machine having a developing device which uses the regulating member 324, when the original document image is determined to be a line image, the regulating member 324 is rotated so that the first portion 324*a* opposes the N magnetic pole of the magnetic roller 21 provided within developing sleeve 20. As a result, the developer is attracted by the first portion 324*a* of the regulating member 324, and a portion of the developer on the developing sleeve 20 remains attracted by the first portion 324*a* of the regulating member 324, thereby reducing the amount of the developer transported to image-bearing member 10 by developing sleeve 20. On the other hand, when the original document image is determined to be an image having many halftone images such as a photographic image, the regulating member 324 is rotated so that the second portion 324*b* opposes the N magnetic pole of the magnetic roller 21 provided within developing sleeve 20. As a result, the developer on developing sleeve 20 is transported while being held by the magnetic force of the magnetic roller 21 and arrives at a position opposite regulating member 324, and more developer is transported to image-bearing member 10 via developing sleeve 20 in accordance with the gap between regulating member 324 and developing sleeve 20 inasmuch as developer is not magnetically attracted to the regulating member 324.

A copying apparatus allowing image modes to be set by a user and provided with a developing device of first or second embodiment according to the present invention is described below with reference to FIG. 8.

Figure 8:
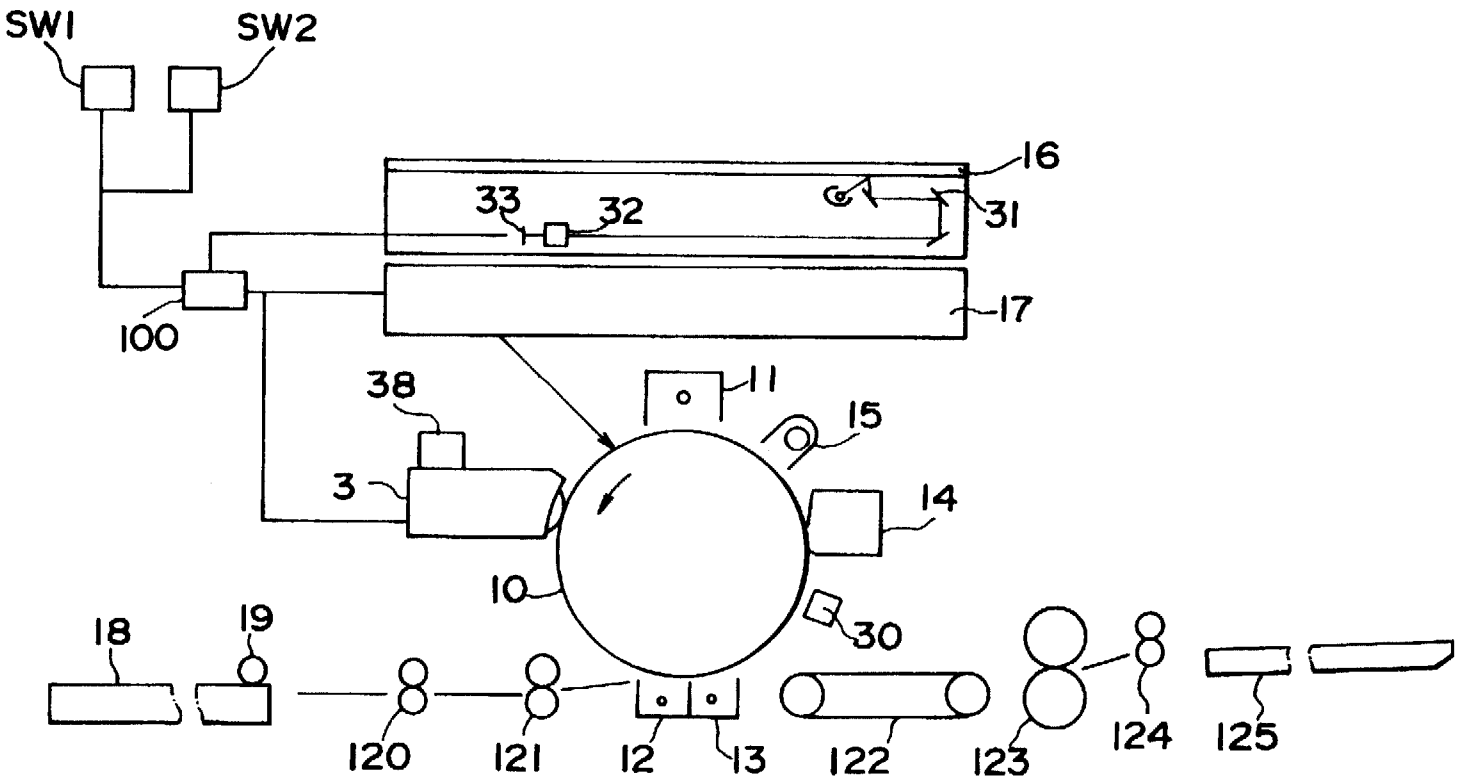
FIG. 8 briefly shows the construction of another digital copying machine provided with a developing device of first or second embodiment according to the present invention.

The copying apparatus shown in FIG. 8 is provided with an operation panel on which a copy switch 200, and switches SW1 and SW2 are disposed. SW1 is used to select a line mode for copying images having much text or many fine lines, and SW2 is used to select a photographic mode for copying halftone images such as photographs. In other respects of the image forming section and image forming operation this copying apparatus is identical to that of the digital copying machine shown in FIG. 1 and, therefore, detailed description is omitted.

Described below is the operation for changing the amount of developer transported to image-bearing member 10 in accordance with an electrostatic latent image formed on said image-bearing member 10 using the regulating member 22 in the developing device of the first embodiment according to the present invention provided in the copying apparatus of FIG. 8.

Figure 9:
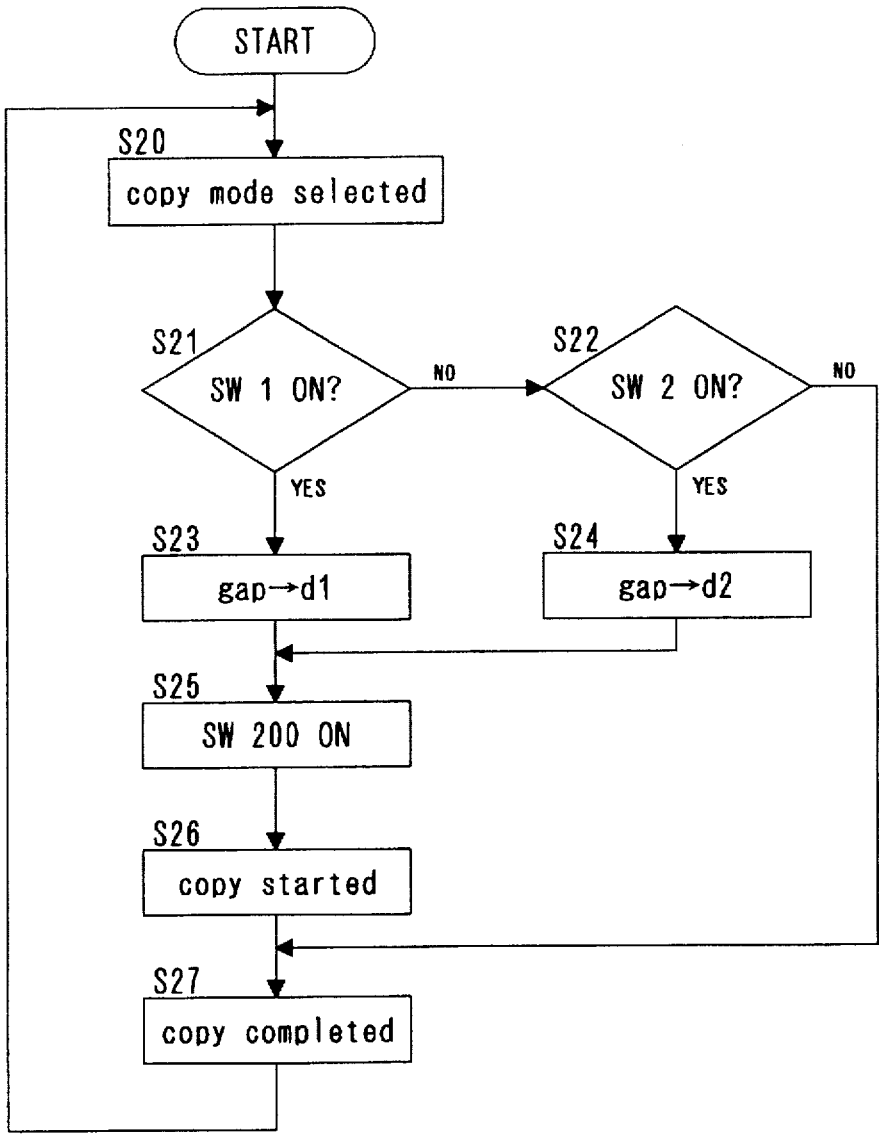
FIG. 9 is a flow chart of the copying operation of the copying machine shown in FIG. 8 provided with a developing device of the first embodiment according to the present invention.

FIG. 9 is a flow chart of the copying operation of the digital copying apparatus of FIG. 8. In step S20, an operator selects a copy mode. When switch SW1 is turned ON in step S21, i.e., when a check determines that the line mode has been selected, the operation continues to step S23. In step S23, the gap between developing sleeve 20 and the surface 22*b* of regulating member 22 is set at gap d1 (refer to FIG. 2(*a*). Thus, the amount of developer transported to image-bearing member 20 is reduced. The operator then turns ON copy switch 200 (step S25), the image forming operation starts in step S26, and the copy operation is completed in step S27.

On the other hand, when switch SW1 is not turned ON in step S21, the operation continues to step S22, and switch SW2 is turned ON, i.e., a check is made to determined whether or not the photograph mode has been set. When it is determined that the photograph mode has been selected in step S22, the gap between the developing sleeve 20 and the surface 22*b* of regulating member 22 is set at gap d2 in step S24 (refer to FIG. 2(*b*)). thus, the amount of developer transported to image-bearing member 10 by developing sleeve 20 is increased. The operator then turns ON the copy switch 200 (step S25), the image forming operation starts in step S26, and the copy operation is completed in step S27.

Described below is the operation for changing the amount of developer transported to image-bearing member 10 in accordance with an electrostatic latent image formed on said image-bearing member 10 using the regulating member 24 in the developing device of the second embodiment according to the present invention provided in the digital copying apparatus as shown in FIG. 8.

Figure 10:
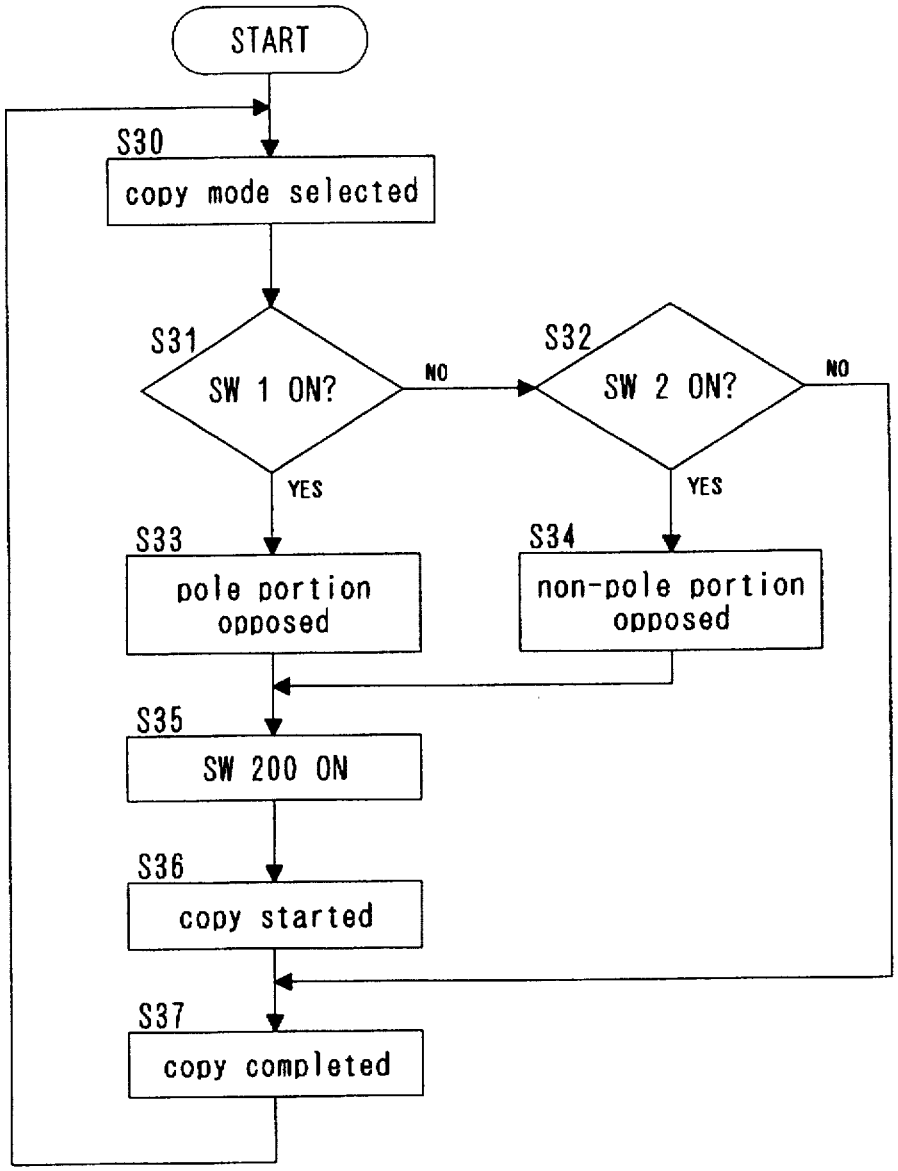
FIG. 10 is a flow chart of the copying operation of the copying machine shown in FIG. 8 provided with a developing device of the second embodiment according to the present invention.

FIG. 10 is a flow chart of the copying operation of the digital copying apparatus of FIG. 8. In step S30, the copy mode is selected by the operator. When switch SW1 is turned ON in step S31, i.e., when a check determines that the line mode has been selected, the operation continues to step S33. Then, in step S33 solenoid 17 is not turned ON and remains in the OFF state, and the S magnetic pole of regulating member 24 approaches developing sleeve 20 at a position opposite the N magnetic pole of magnetic roller 21 provided within developing sleeve 20, as shown in FIGS. 5(*a*) and 6(*a*). Thus, as shown in FIG. 11(*a*), when the developer D on the surface of developing sleeve 20 is transported while being held by the magnetic force of magnet roller 21 and arrives at a position opposite regulating member 24, said developer D is attracted by the S magnetic pole of regulating member 24 and a portion of the developer D on developing sleeve 20 remains attracted by the S magnetic pole of regulating member 24, thereby reducing the amount of developer D transported to image-bearing member 10 by developing sleeve 20.

Then, the operator turns ON the copy switch 200 (step S35), and the image forming operation starts in step S36, and the copy operation is completed in step S37.

On the other hand, when switch SW1 is not turned ON in step S31, the operation continues to step S32 and switch SW2 is turned ON, i.e., a check is made to determine whether or not the photograph mode has been set. When the check determines that the photograph mode has been set in step S32, the operation continues to step S34. Then, as shown in FIGS. 5(*b*) and 6(*b*), solenoid 27 is turned ON in step S34 to rotate regulating member 24 against the force of spring 26 and separate the S magnetic pole of regulating member 24 from developing sleeve 20, and the region medial to the N magnetic pole and the S magnetic pole of regulating member 24 is brought opposite developing sleeve 20. Thus, as shown in FIG. 11(*b*), the developer D on developing sleeve 20 is transported while being held by the magnetic force of magnetic roller 21 and arrives at a position opposite regulating member 24, and more developer D is transported to image-bearing member 10 via developing sleeve 20 in accordance with the gap between regulating member 24 and developing sleeve 20 inasmuch as developer D is not magnetically attracted to regulating member 24.

Then, the operator turns ON the copy switch 200 (step S35), the image forming operation starts in step S36, and the copy operation is completed in step S37.

Described below are the affects on development produced by changing the amount of developer transported to image-bearing member 10 by developing sleeve 20 using the regulating members 22, 23, 24, 224, and 324 in the developing devices of the previously described embodiments.

Figure 12:
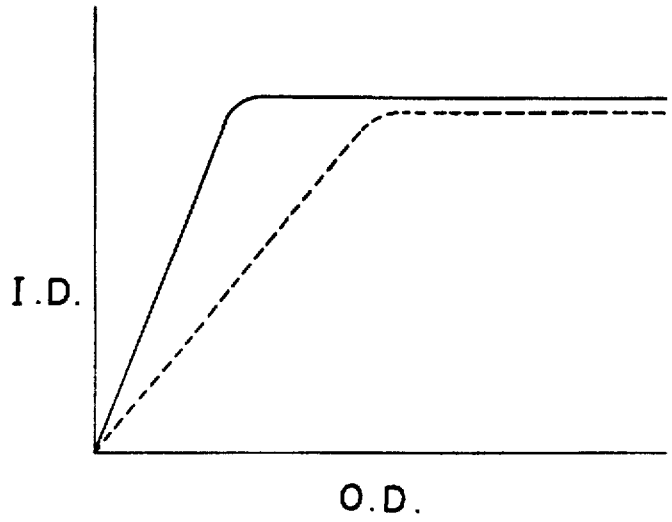
FIG. 12 shows the relationship between the developed image density (ID: image density) and the original document density (OD: original density) when a large amount and when a small amount of developer is transported to the image-bearing member when developing via a direct current bias voltage applied between the developing sleeve and image-bearing member using a developing device of first or second embodiment according to the present invention.

Although a bias voltage comprising an overlaid DC voltage and AC voltage is applied between developing sleeve 20 and image-bearing member 10 in the aforesaid developing devices, a DC bias voltage is applied between developing sleeve 20 and image-bearing member 10 in the aforesaid developing devices to accomplish development. FIG. 12 shows the relationship between the original density (OD) of the document and the image density (ID) of the developed image; the solid line indicates the result when a large amount of developer is transported to image-bearing member 10, and the dashed line indicates the result when a small amount of developer is transported to image-bearing member 10.

When a DC bias voltage is applied between the developing sleeve 20 and image-bearing member 10 and a small amount of developer is transported, the value $\gamma$ expressing the ratio of change of ID relative to OD becomes smaller to accurately reproduce the halftones of a photographic document, whereas when a large amount of developer is transported, the value $\gamma$ becomes greater to accurately reproduce fine lines of a document and suitably develop text documents.

Figure 13:
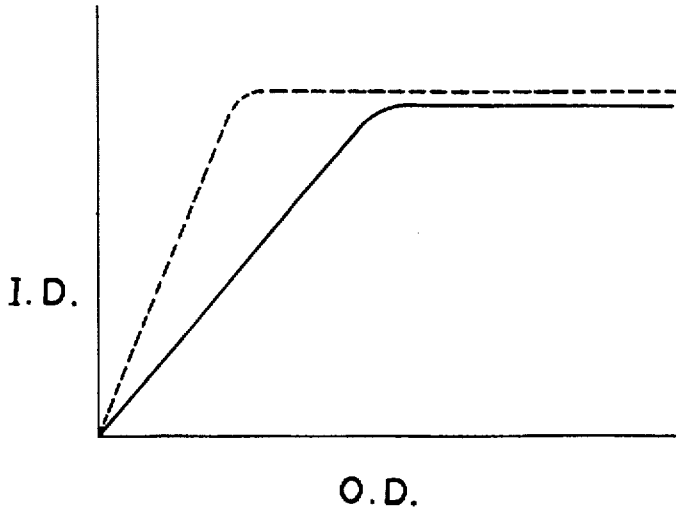
FIG. 13 shows the relationship between the developed image density (ID:image density) and the original document density (OD: original density) when a large amount and when a small amount of developer is transported to the image-bearing member when developing via an overlaid direct current and alternating current bias voltage applied between the developing sleeve and image-bearing member using a developing device of first or second embodiment according to the present invention.

Furthermore, the relationship between OD and ID was investigated when a bias voltage comprising an overlaid DC voltage and AC voltage is applied between developing sleeve 20 and image-bearing member 10 as performed in the aforesaid developing devices. In contrast to the result when a DC voltage alone was applied, FIG. 13 shows that the value $\gamma$ becomes larger when a small amount of developer is transported, and the value $\gamma$ becomes smaller when a large amount of developer is transported, i.e., just the opposite result of when a DC voltage alone is applied.

These divergent results are believed to be caused by the separation of toner from the carrier in the developer due to the application of the AC voltage when a small amount of developer is transported, with said separated toner being used to accomplish development.

Accordingly, when a DC voltage is applied between the developing sleeve and image-bearing member, the relationship between the images to be reproduced and the amount of the developer to be transported is contrary to that as described in the above embodiments according to the present invention.

Further, although the status of the images to be reproduced is determined based upon the image on the original document in the present embodiments, it may be determined based on the electrostatic latent image on the image-bearing member 10.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A developing device which develops a latent image on an image-bearing member in an image forming apparatus, said developing device comprising:

a developer transporting member opposite to the image-bearing member to form a developing region therebetween, said developer transporting member transporting a developer held thereon to the image-bearing member; and a rotatable regulating member provided at an upstream side from said developing region with respect to a developer transporting direction and regulating an amount of the developer held on the developer transporting member, said regulating member including a regulating portion which has a section wherein a distance from a rotational axis of the regulating member to periphery of the regulating portion is not fixed.

2. A developing device as claimed in claim 1 wherein said regulating portion is a roller having an ellipse shape of section.

3. A developing device as claimed in claim 1 wherein said developer transporting member includes a developing sleeve and a magnetic roller provided therein.

4. A developing device which develops a latent image on an image-bearing member in an image forming apparatus, said developing device comprising:

a developer transporting member opposed to the image-bearing member to form a developing region therebetween, said developer transporting member transporting a developer held thereon to the image-bearing member at said developing region; and a rotatable regulating member provided at an upstream side from said developing region with respect to a developer transporting direction and regulating an amount of the developer held on the developer transporting member, said regulating member including a plurality of regulating portions, and a distance from a rotational axis of the regulating member to each of the regulating portions being different from each other.

5. A developing device as claimed in claim 4 wherein said regulating member is composed of a rotatable roller, and a plurality of the regulating portions provided around the rotatable roller at different distances from the rotational axis of the regulating member.

6. A developing device as claimed in claim 4 wherein said developer transporting member includes a developing sleeve and a magnetic roller provided therein.

7. A developing device which develops a latent image on an image-bearing member in an image forming apparatus, said developing device comprising:

a developer transporting member including a magnet member inside thereof and opposed to the image-bearing member, said developer transporting member transporting a developer held thereon to the image-bearing member;

a rotatable regulating member opposite to the developer transporting member for regulating an amount of the developer held on the developer transporting member, said regulating member being provided with a magnet having a magnetic pole; and a rotating member which rotates the regulating member so that either of the pole of the magnet of the regulating member or a portion other than the pole of the magnet of the regulating member is opposite to the developer transporting member upon development.

8. A developing device which develops a latent image on an image-bearing member in an image forming apparatus, said developing device comprising:

a developer transporting member including a magnet member inside thereof and opposed to the image-bearing member, said developer transporting member transporting a developer held thereon to the image-bearing member;

a rotatable regulating member opposite to the developer transporting member for regulating an amount of the developer held on the developer transporting member, said regulating member including a first surface area including a magnetic material and a second surface area including a non-magnetic material; and a rotating member which rotates the regulating member so that either of the magnetic material of the regulating member or non-magnetic material of the regulating member is opposite to the developer transporting member upon development.

9. A developing device which develops a latent image on an image-bearing member in an image forming apparatus, said developing device comprising:

a developer transporting member including a magnet member inside thereof and opposed to the image-bearing member, said developer transporting member transporting a developer held thereon to the image-bearing member; and a rotatable regulating member opposite to the developer transporting member for regulating an amount of the developer held on the developer transporting member, said regulating member including a portion having high permeability and a portion having low permeability.

10. A developing device as claimed in claim 9 further comprising:

a rotating member which rotates the regulating member so that either of the portion having high permeability of the regulating member or the portion having low permeability of the regulating member is opposite to the developer transporting member upon development.

11. An image forming apparatus which reproduces an image, said image forming apparatus comprising:

an image-bearing member;

a developer transporting member opposed to said image-bearing member and transporting a developer held thereon to the image-bearing member;

a detecting member which detects a status of an image to be reproduced;

a regulating member opposite to the developer transporting member through a predetermined gap and regulating an amount of the developer held on the developer transporting member; and a controller which controls the regulating member so as to change a gap between the regulating member and the developer transporting member in accordance with the status of the image to be reproduced.

12. An image forming apparatus as claimed in claim 11 wherein said detecting member detects an original image.

13. An image forming apparatus as claimed in claim 11 wherein said detecting member detects whether the image to be reproduced is a line image or a halftone image.

14. An image forming apparatus as claimed in claim 11, wherein:

the developer transporting member forms a developing region between the developer transporting member and the image-bearing member; and the regulating member is rotatable and is provided at an upstream side from said developing region with respect to a developer transporting direction, said regulating member including a regulating portion which has a section wherein a distance from a rotational axis of the regulating member to a periphery of the regulating portion is not fixed.

15. An image forming apparatus as claimed in claim 11, wherein the developer transporting member forms a developing region between the image-bearing member and the developer transporting member, said developer transporting member transporting the developer held thereon to the image bearing member at said developing region; and the regulating member is rotatable and is provided at an upstream side from said developing region with respect to a developer transporting direction, said regulating member including a plurality of regulating portions, and a distance from a rotational axis of the regulating member to each of the regulating portions being different from each other.

16. An image forming apparatus as claimed in claim 11, wherein:

the developer transporting member includes a magnet member inside thereof;

the regulating member is rotatable and is provided with a magnet having a magnetic pole; and further comprising a rotating member which rotates the regulating member so that either of the pole of the magnet of the regulating member or a portion other than the pole of the magnet of the regulating member is opposite to the developer transporting member upon development.

17. An image forming apparatus as claimed in claim 11, wherein the developer transporting member includes a magnet member inside thereof;

the regulating member is rotatable and includes a magnetic material and a non-magnetic material.

18. An image forming apparatus as claimed in claim 11, wherein:

the developer transporting member includes a magnet member inside thereof;

the regulating member is rotatable, said regulating member includes a portion having high permeability and a portion having low permeability.

19. An image forming apparatus which reproduces an image, said image forming apparatus comprising:

an image-bearing member;

a developer transporting member opposed to said image-bearing member and transporting a developer held thereon to the image-bearing member;

a detecting member which detects a status of an image to be reproduced;

a regulating member regulating an amount of the developer held on the developer transporting member; and a controller which controls the regulating member so as to change the amount of the developer held on the developer transporting member in accordance with the status of the image to be reproduced.

20. An image forming apparatus as claimed in claim 19 wherein said detecting member detects an original image.

21. An image forming apparatus as claimed in claim 19 wherein said detecting member detects whether the image to be reproduced is a line image or a halftone image.

22. An image forming apparatus as claimed in claim 19, wherein said regulating member regulates a thickness of a layer of the developer held on the developer transporting member, and the controller controls the regulating member so as to control the thickness of the layer.

23. An image forming apparatus as claimed in claim 19, wherein:

the developer transporting member forms a developing region between the developer transporting member and the image-bearing member; and the regulating member is rotatable and is provided at an upstream side from said developing region with respect to a developer transporting direction for regulating an amount of the developer held on the developer transporting member, said regulating member including a regulating portion which has a section wherein a distance from a rotational axis of the regulating member to a periphery of the regulating portion is not fixed.

24. An image forming apparatus as claimed in claim 19, wherein the developer transporting member forms a developing region between the image-bearing member and the developer transporting member transporting the developer held thereon to the image-bearing member at said developing region; and the regulating member is rotatable and is provided at an upstream side from said developing region with respect to a developer transporting direction for regulating an amount of the developer held on the developer transporting member, said regulating member including a plurality of regulating portions, and a distance from a rotational axis of the regulating member to each of the regulating portions being different from each other.

25. An image forming apparatus as claimed in claim 19, wherein:

the developer transporting member includes a magnet member inside thereof;

the regulating member is rotatable, regulates an amount of the developer held on the developer transporting member, and is provided with a magnet having a magnetic pole; and further comprising a rotating member which rotates the regulating member so that either of the pole of the magnet of the regulating member or a portion other than the pole of the magnet of the regulating member is opposite to the developer transporting member upon development.

26. An image forming apparatus as claimed in claim 19, wherein the developer transporting member includes a magnet member inside thereof;

the regulating member is rotatable, regulates an amount of the developer held on the developer transporting member, and includes a magnetic material and a non-magnetic material.

27. An image forming apparatus as claimed in claim 19, wherein:

the developer transporting member includes a magnet member inside thereof; and the regulating member is rotatable, regulates an amount of the developer held on the developer transporting member, and includes a portion having high permeability and a portion having low permeability.

28. A method performed in an image forming apparatus for reproducing an image comprising an image-bearing member and a developer transporting member transporting a developer held thereon to the image-bearing member, said method comprising the steps:

detecting a status of an image to be reproduced; and changing an amount of the developer held on the developer transporting member in accordance with the status of the image to be reproduced.

29. A method as claimed in claim 28 wherein said detecting detects a status of an original image.

30. A method as claimed in claim 29 wherein said detecting detects whether the image to be reproduced is a line image or a halftone image.

* * * * *